United States Patent [19]

Witten

[11] Patent Number: 4,782,896

[45] Date of Patent: Nov. 8, 1988

[54] RETRIEVABLE FLUID FLOW CONTROL NOZZLE SYSTEM FOR WELLS

[75] Inventor: Eric B. Witten, Anchorage, Ak.

[73] Assignee: Atlantic Richfield Company, Los Angeles, Calif.

[21] Appl. No.: 55,489

[22] Filed: May 28, 1987

[51] Int. Cl.[4] ..... E21B 34/06; E21B 23/02

[52] U.S. Cl. ..... 166/116; 166/115; 166/222; 166/169

[58] Field of Search ..... 166/222, 298, 316, 269, 166/372, 385, 386, 242, 169, 150, 115, 116

[56] References Cited

U.S. PATENT DOCUMENTS

| | | | |
|---|---|---|---|
| 1,379,815 | 5/1921 | Hall | 166/222 |
| 1,510,669 | 10/1924 | Halliday | 166/115 |
| 2,537,066 | 1/1951 | Lewis | 166/115 |
| 2,826,254 | 3/1958 | O'Neill | 166/316 |
| 3,454,085 | 7/1969 | Bostock | 166/115 |

*Primary Examiner*—Jerome W. Massie, IV

*Assistant Examiner*—Bruce M. Kisliuk

*Attorney, Agent, or Firm*—Michael E. Martin

[57] ABSTRACT

A system for controlling the flow of injection fluids and production fluids between a wellbore and one or more zones in a subterranean formation including an elongated tubing string extending within the wellbore and having one or more tubular ported mandrels interposed in the tubing string. Retrievable sleeves are insertable through the tubing string for registration with the mandrels in predetermined longitudinal and rotational positions as determined by a no-go shoulder on the mandrel and cooperating keys and key slots formed on the sleeves and the mandrels, respectively. The sleeves include removable orifice plugs which may be sized to control the flow of fluid through the sleeves between the tubing string and the wellbore. The sleeves are wireline insertable and retrievable so that changes in fluid flow control characteristics may be selectively carried out without pulling the tubing string from the wellbore.

9 Claims, 3 Drawing Sheets

RETRIEVABLE FLUID FLOW CONTROL NOZZLE SYSTEM FOR WELLS

BACKGROUND OF THE INVENTION

Field of the Invention

The present invention pertains to a retrievable tubular sleeve type fluid flow control nozzle system for use in controlling fluid flow into and out of oil and gas wells and the like.

Background

In certain operations for the production of crude oil from one or more subterranean formations, water and other fluids are typically injected through an injection well after the natural formation pressure subsides so as to enhance the total recovery of oil. Typically, water is injected through a tubing string extending into the injection well and the flow may be controlled by valve means interposed in the tubing string. Such valve means include the provision of a sliding sleeve adapted to close over ports in the tubing sidewalls.

As multiple production zones are developed for production, the injection pressures required to produce a uniform flood front may vary as the flood front progresses or due to formation physical characteristics. Accordingly, it is desirable to be able to adjust the flow of injection fluid from the tubing string in accordance with the particular zone of the formation into which the fluid is being injected in order to control the flood front. This operation has been difficult to accomplish with prior art injection apparatus.

The fluid injection flow control problems associated with water and other liquids applies as well to gas injection and gas lift systems. In gas lift by both gas cap sources of lifting gas and by injection of lifting gas it is desirable to be able to control the gas flow by a selectable orifice or flow control device which may be inserted in and removed from the tubing system.

Accordingly, prior art methods of control of fluid injection into single or multiple formation zones, as well as flow control of injection or lifting gas, has met with certain shortcomings which have been alleviated with the present invention as will be appreciated by those skilled in the art.

SUMMARY OF THE INVENTION

The present invention provides an improved flow control system for use in injecting fluids into a subterranean formation for stimulating the production of hydrocarbons and similar mineral values. In accordance with an important aspect of the present invention, there is provided a system for injecting fluids, such as water and gas, into a wellbore wherein a tubing string includes one or more ported mandrels interposed therein and a replaceable sleeve insert is inserted in the tubing string adjacent to each mandrel and is provided with multiple flow control orifices for controlling the flow of fluid into and out of the tubing string. The flow control orifice sleeve is adapted to cooperate with the mandrel to be aligned in such a way that flow control orifices in the sleeve are aligned with ports in the mandrel so that the mandrel itself does not interfere with injection fluid flow and erosion of the mandrel is minimized.

The sleeve is adapted to be inserted in and removed from the tubing string by conventional wireline equipment including a conventional wireline locking mechanism for locking the sleeve in place in its preferred location in the mandrel. The sleeve is also adapted to include removable orifice plugs which may be interchanged with plugs of larger or smaller orifice size so that the flow of fluids through the sleeve may be controlled.

In accordance with another important aspect of the present invention, there is provided a flow control system for controlling the flow of injection fluids into multiple zones so as to maintain a substantially uniform injection fluid flood front in zones wherein the permeability or resistance to fluid flow varies. In this way, drive fluid breakthrough or fingering may be minimized and a more even or uniform fluid drive front provided.

Still further, the present invention provides improved means for controlling gas injection and gas lift operations by the provision of a flow control orifice system which may be easily modified to vary the flow control orifice size within a tubing string.

The abovementioned features and advantages of the present invention, as well as other superior aspects thereof will be further appreciated by those skilled in the art upon reading the detailed description which follows in conjunction with the drawing.

DESCRIPTION OF THE PREFERRED EMBODIMENTS

Figure 1:
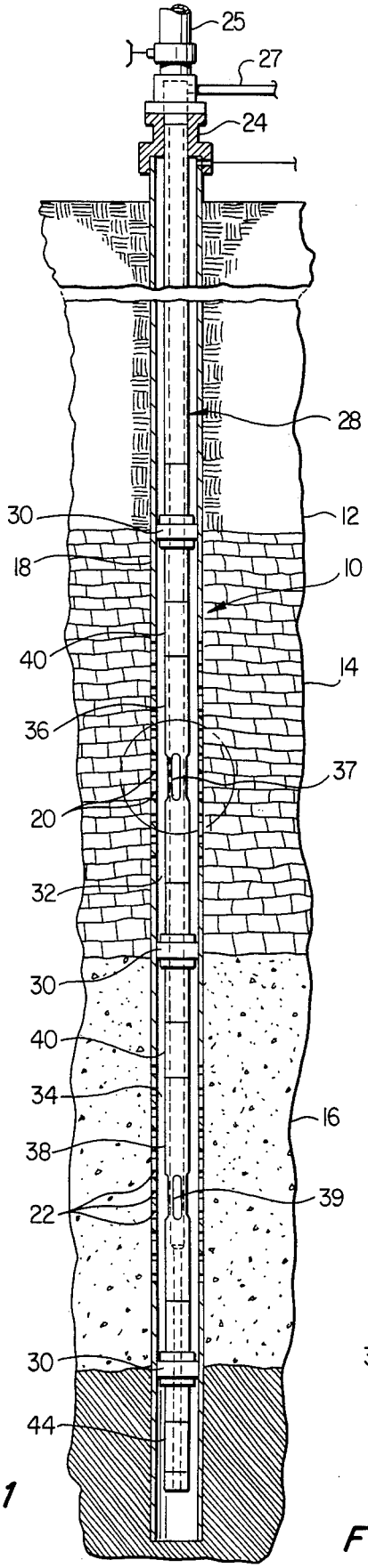
FIG. 1 is a somewhat schematic cross-section view, of a fluid injection well wherein injection fluids such as water may be controlled for injection into one or more zones of a subterranean formation.

In the description which follows, like parts are marked throughout the specification and drawing with the same reference numerals, respectively. The drawing figures are not necessarily to scale and certain features of the invention may be shown in somewhat schematic form in the interest of clarity and conciseness.

Figure 1A:
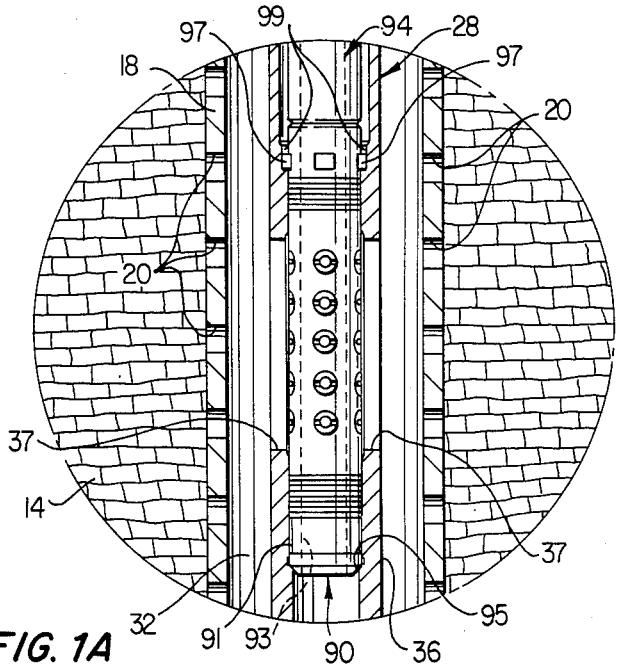
FIG. 1A is an enlarged detail view of the area encircled in FIG. 1.

Referring now to FIG. 1 and FIG. 1A, there is illustrated in somewhat schematic form, a vertical section view of an injection well 10 which has been drilled into a subterranean formation 12. The formation 12 may have one or more production zones 14 and 16, for example, from which crude oil is to be produced through a production well, not shown. The well 10 includes casing means 18 which is suitably perforated at the zone 14 by perforations 20, see detail portion of FIG. 1, and perforated at the zone 16 by perforations 22. The casing 18 extends to a wellhead 24 of conventional construction and on which a wireline lubricator and stuffing box assembly 25 is mounted and partially shown in FIG. 1.

The well 10 is provided with a tubing string 28 extending from the wellhead within the casing 18. The tubing string 28 includes a plurality of packers 30 interposed therein and operable to suitably isolate interior spaces 32 and 34 within the casing 18. The tubing string 28 also includes spaced apart fluid flow control mandrels 36 and 38 which are similar in construction and differ only with respect to their internal diameter, as will be further appreciated from the following discussion. The tubing string 28 also includes suitable subs 40 interconnecting the mandrels with other components in the tubing string, such as the packers 30. The lowermost packer 30 may have a tailpipe section connected thereto, generally designated by the numeral 44, which may have a closed end plug member 46 connected thereto or a plug having a suitable flow control orifice formed therein, not shown. As illustrated in FIG. 1, the mandrels 36 and 38 are interposed in the spaces 32 and 34 whereby liquid may be injected through the tubing string 28 and into the respective formation zones 14 and 16 through suitable elongated slots 37 and 39 formed in the mandrels 32 and 34, respectively.

Figure 3:
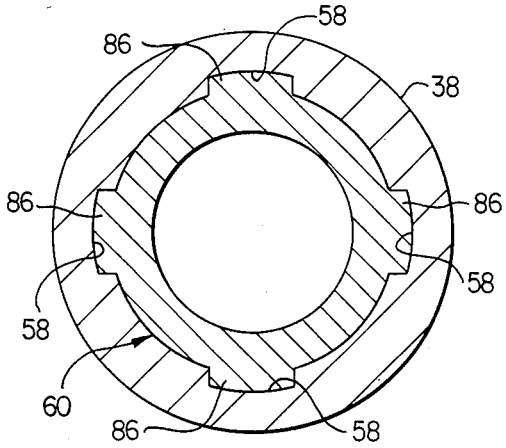
FIG. 3 is a section view taken along the line 3—3 of FIG. 2A.
Figure 2A:
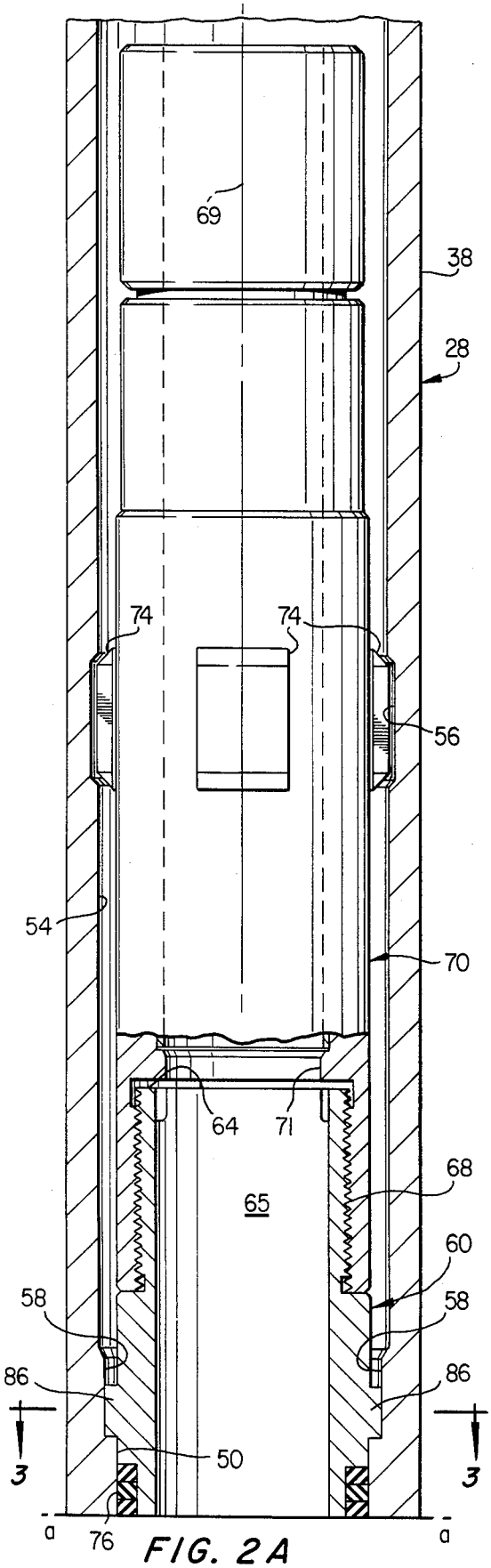
FIGS. 2A and 2B comprise a longitudinal central section view of the fluid injection control sleeve and tubing mandrel in accordance with the present invention.
Figure 2B:
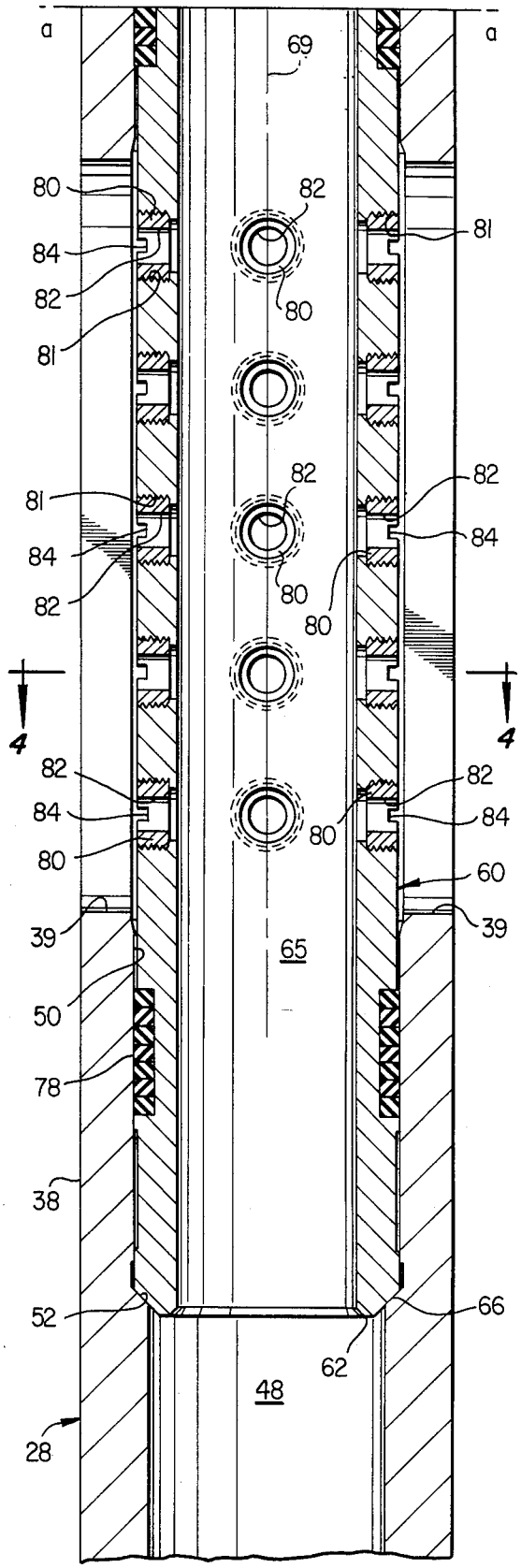

Referring now to FIGS. 2A and 2B, a central longitudinal section view of the portion of the tubing string 28, including a portion of the mandrel 38, is illustrated. The mandrel 38 includes an internal passage 48 defined in part by a bore 50 which is reduced in diameter by a shoulder 52 at the point indicated in FIG. 2B. The mandrel 38 also includes an annular groove or recess 56, FIG. 2A, spaced on the opposite side of the slots 39 from the shoulder 52. Still further, the mandrel 38 includes circumferentially spaced longitudinally extending slots or keyways 58, see FIG. 3 also, which open into an enlarged bore portion 54 and are for a purpose to be described in further detail herein. The mandrel 38 is also provided with suitable means, not shown, for connecting the mandrel into the tubing string such as conventional threaded box and pin sections at its opposite ends.

The mandrel 38 is adapted to receive a fluid flow control sleeve, generally designated by the numeral 60. The sleeve 60 is an elongated cylindrical tubular member which is open at its opposite ends 62 and 64 to provide a passage 65 comprising continuation of the passage 48. The end 62 of the sleeve 60 is provided with a beveled edge 66 which is operable to engage the shoulder 52 to form a no-go stop for the sleeve as it is lowered into the tubing string 28. The sleeve end 64 is adapted to have suitable thread 68 or similar means for connecting the sleeve to a wireline lock mechanism, generally designated by the numeral 70. The lock mechanism 70 may be of a type commercially available such as a type AF Wireline Lock manufactured by Baker Packers Division of Baker International, Houston, Texas. The lock mechanism 70 includes radially extendable and retractable keys 74 which are registerable in the groove 56 to lock the sleeve 60 in the position shown in FIG. 2. The sleeve 60 is also provided with spaced apart seals or packings 76 and 78 which are engageable with the borewalls of the mandrel 38 to form substantially fluid-tight seals at opposite ends of the slots 39.

Figure 4:
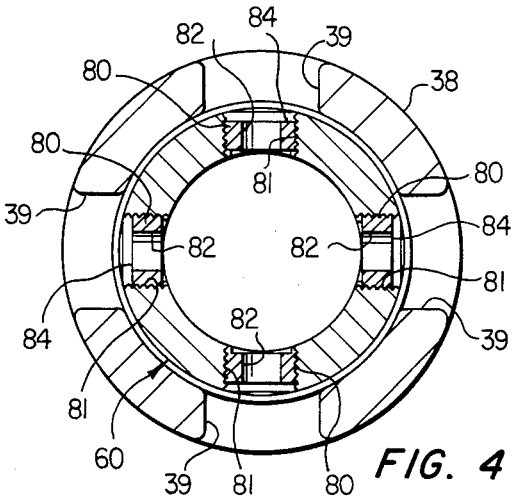
FIG. 4 is a section view taken along the line 4—4 of FIG. 2B.

The sleeve 60 also includes a plurality of longitudinally and circumferentially spaced apart orifice plugs 80 which are threadedly inserted in cooperating bores 81 formed in the sleeve. Each of the orifice plugs 80 has an orifice 82 formed therein and a transverse screwdriver slot 84 to facilitate insertion of and removal of the plugs from the bores 81. As illustrated in FIG. 4, the sleeve 60 is provided with four sets of orifice plugs 80 which are aligned with each of the four slots 39, respectfully, so that high pressure fluid, such as water, being injected through the plugs will flow through the slots 39 and avoid the hydraulic losses and erosion of the mandrel 38 which would occur if the orifices in the sleeve were not properly aligned with the slots. Alignment of the orifices 82 with the slots 39 is provided by a plurality of radially projecting key portions 86, see FIGS. 2A and 3, which are operable to be in registration with the grooves 58 for aligning the sleeve in such a way that the orifices 82 are aligned with the slots 39 as shown and described. The sleeve 60 is rotated with respect to central axis 69 until the key portions 86 are aligned with the slots 58 and then the sleeve is fully seated against the shoulder 52.

The sleeve 60 may be easily inserted in and removed from the mandrel using conventional wireline setting and removing tools, not shown, which may be engaged with and disengaged from the lock mechanism 70. When the wireline setting tool has been removed from the lock mechanism 70, an internal passage 71 is formed in the mechanism which is in communication with the interior passage 65 of the sleeve 60 and the passage 48 whereby fluids may be pumped down through the tubing string 28 from a suitable source, not shown, by way of a conduit 27, FIG. 1, connected to the wellhead 24. By selection of the number of orifice plugs 80 to be inserted in the respective bores 81 pressure and flow control of water being injected into the tubing string and out through the orifices into the space 34, for example, may be easily controlled. Some of the orifice plugs 80 may be replaced by solid plugs, not shown, or plugs with different orifice sizes. If operating conditions in the well or formation being treated change, the sleeve 60 may be easily retrieved by a wireline tool, not shown, and replaced with a similar sleeve or replacement of selected ones of the orifice plugs may be easily carried out and the sleeve reinserted in the tubing string.

Referring again to FIG. 1A, the mandrel 36 is similarly adapted to receive a sleeve 90 which is very similar in construction to the sleeve 60 except for having a larger outside diameter 91 and an inner passage 93 and wherein the mandrel 36 is also provided with larger diameter bore portions to permit insertion of the sleeve 60 through the tubing string and past the mandrel 36 before registration with the no-go shoulder 52 formed on the mandrel 38. In making up the fluid flow control means for the tubing string 28, the mandrel 38 would be placed in the tubing string below the mandrel 36 and the sleeve 60 would typically be inserted into its position in the mandrel 38 before the sleeve 90 is inserted into the tubing string for registration with an appropriate no-go shoulder 95, FIG. 1A, formed on the sleeve 36. Of course, if tubing and wellbore dimensions permitted, the sleeves 60 and 90 could be dimensioned to provide for insertion of the sleeve 60 to its final position by being passed through sleeve 90. The sleeve 90 is also provided with rotational alignment key portions 97, see FIG. 1A enlarged detail, which are adapted to be fitted in cooperating grooves 99 in the mandrel 36. The sleeve 90 is also adapted to be locked in place by a lock mechanism 94 similar to the mechanism 70.

As will be appreciated from the foregoing description, the sleeves 60 and 90 may be inserted in the tubing string 28 after being fitted with appropriate sized orifices formed on the orifice plugs 80 and which can be used with both sleeves. In this way, the control of fluid flow into the formation zones or regions 14 and 16 can be selected, at will, to provide a uniform flood or drive front expanding outwardly from the wellbore through the casing perforations. Those skilled in the art will recognize that the removable flow control orifice sleeves 60 and 90 may also be utilized to control the production of fluids from the formation 12 if the well 10 is a production well. Here again, the sleeves 60 and 90 may be easily interchanged, at will, with sleeves having different orifice plugs or the orifice plugs 80 themselves may be replaced and the sleeves reinserted to control the flow of well fluids from the respective formation zones 14 and 16.

Figure 5:
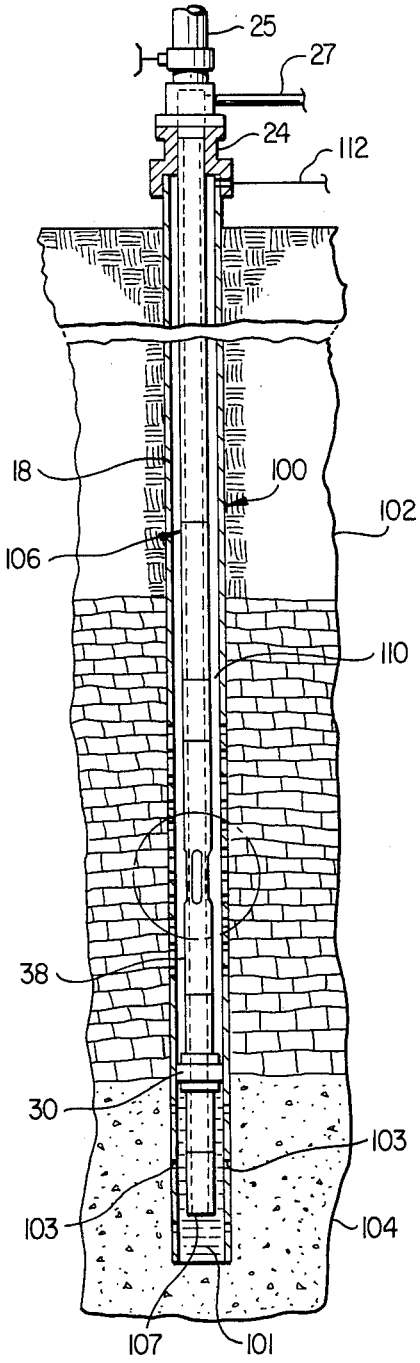
FIG. 5 is a cross-section, of an alternate arrangement of the fluid flow control system of the present invention.
Figure 5A:
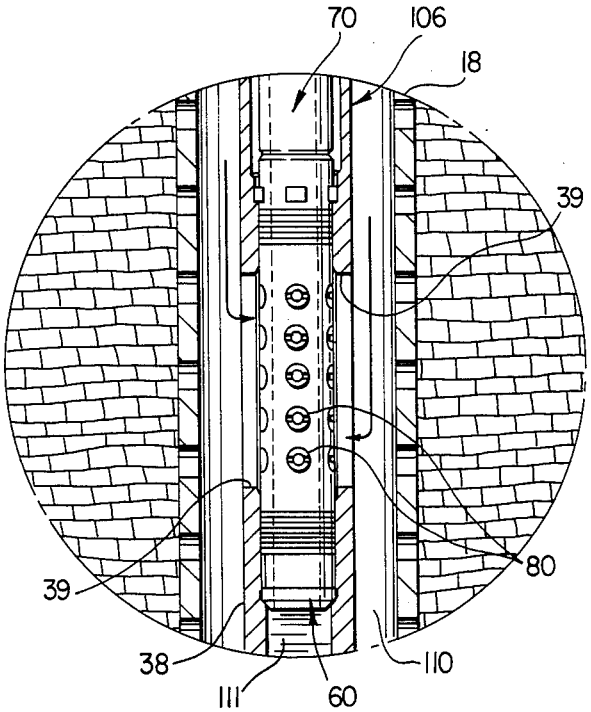
FIG. 5A is an enlarged detail view of the area encircled in FIG. 5.

Referring now to FIG. 5 and FIG. 5A, there is illustrated a well 100 also formed with casing 18 extending into a formation 102 and perforated at perforations 103 into a production zone 104. The well 100 includes the wellhead 24 and a conventional wireline lubricator 25 for use in inserting and removing tools with a conventional wireline apparatus, not shown. The well 100 includes an elongated tubing string 106 extending within the casing 18 and having interposed therein a packer 30 set above the zone 104. The tubing string 106 includes a ported mandrel 38 interposed therein above the packer 30 and adapted to receive a flow control orifice sleeve 60, see FIG. 5A enlarged detail, in the same manner as illustrated in FIG. 2. The well 100 is adapted to operate as a production well utilizing artificial gas lift wherein a gaseous lifting fluid is injected into the casing annulus 110 by way of a suitable injection line 112 from a source, not shown. Injection gas flows down through the annulus 110 and into the tubing string 106 through the orifice plugs 80 to lift a column of oil 111, see FIG. 5A enlarged detail, being produced from the formation region 104 and flowing into the wellbore 101 and the tubing string at 107 through the casing perforations 103. Those skilled in the art will recognize that the flow control orifice sleeve 60 and its associated mandrel 38 may be utilized in wells wherein gas lift or gas production is being carried out from a gas cap or gas producing formation as well as in conjunction with artificial gas lift using injected gas as shown and described in conjunction with FIG. 5.

Accordingly, the present invention provides improved means for selectively controlling the flow of fluids into and out of a tubing string in a producing or injection well wherein single or multiple injection or production zones are undergoing flow of fluids at selected pressures and flow rates. The sleeves 60 and 90 are easily inserted in or removed from the tubing string in a conventional manner in utlizing conventional wireline setting and pulling equipment. Thanks to the arrangement of the alignment slots or keyways in the mandrels and the cooperating longitudinally extending key portions on the sleeves, the orifices in the sleeves are aligned with the ports or slots in the mandrel to reduce flow losses within the wellbore and to minimize the erosion of the mandrel itself. The mandrel and sleeve are made of conventional engineering materials and the removable orifice plugs are preferably made of a hardened metal, such as tungsten carbide to minimize the erosion or change in diameter of the orifices themselves.

Although preferred embodiments of the invention have been described herein in detail, those skilled in the art will recognize that various substitutions and modifications may be made to the embodiments shown and described without departing from the scope and spirit of the invention as recited in the appended claims.

What is claimed is:

1. In a system for controlling the injection of fluids from a wellbore to a subterranean earth formation wherein said wellbore includes an elongated tubing string extending within said wellbore, the improvement comprising:

a generally tubular mandrel interposed in said tubing string and including port means for conducting fluid into said wellbore from a passage in said tubing string; and an elongated sleeve insertable through said tubing string and within said mandrel, said sleeve including means forming at least one orifice means in said sleeve and in communication with an interior passage formed in said sleeve for controlling the flow of fluid from said tubing string to said wellbore through said port means in said mandrel;

said sleeve and said mandrel including cooperable means for locating said orifice means longitudinally within said tubing string relative to said port means and for locking said sleeve in a predetermined rotational position with respect to the longitudinal axis of said sleeve and said mandrel for aligning said orifice means with said port means to minimize flow losses and erosion of said mandrel during injection of fluid from said orifice means into said wellbore through said port means.

2. The system set forth in claim 1 wherein:

said cooperable means include slot means formed in said mandrel and locating key means formed on said sleeve for registration with said slot means to rotationally position said sleeve within said mandrel.

3. The system set forth in claim 1 wherein:

said sleeve includes means forming a plurality of orifices spaced apart circumferentially on said sleeve and said port means in said mandrel comprises a plurality of ports spaced apart circumferentially on said mandrel at spacings corresponding to the spacings of said orifices in said sleeve.

4. The system set forth in claim 3 wherein:

said sleeve includes orifices spaced apart longitudinally along said sleeve.

5. The system set forth in claim 3 wherein:

said means forming said orifices comprise a plurality of orifice plugs insertable in corresponding bores formed in said sleeve spaced circumferentially and longitudinally on said sleeve.

6. In a system for producing fluids from a subterranean wellbore, an elongated tubing string extending into said wellbore and including means for sealing a first zone in said wellbore from a second zone in said wellbore longitudinally spaced from said first zone, said tubing string extending into said first and second zones, a tubular mandrel inserted in said tubing string in said second zone and including port means opening into said second zone from a passage in said mandrel, a retrievable sleeve member insertable within said tubing string and within said mandrel, said sleeve member including at least one orifice means formed therein of predetermined size for controlling the flow of fluid from said second zone in said wellbore into said tubing string for producing fluids from said first zone by fluid lift, said sleeve member being retrievable from the interior of said tubing string without retrieving said tubing string from said wellbore, and said sleeve member and said mandrel including cooperable means for locating said sleeve member longitudinally in said mandrel and for locking said sleeve member against rotation and in a predetermined rotational position with respect to said mandrel for aligning said orifice means with said port means so that the flow of fluid from said second zone is controlled substantially by said orifice means.

7. The system set forth in claim 6 wherein:

said cooperable means include slot means formed in said mandrel and locating key means formed on said sleeve member for registration with said slot means to rotationally position said sleeve member within said mandrel.

8. The system set forth in claim 7 wherein:

said sleeve member includes means forming a plurality of orifices spaced apart circumferentially on said sleeve member and said port means in said mandrel comprises a plurality of ports spaced apart circumferentially on said mandrel at spacings corresponding to the spacings of said orifices in said sleeve member.

9. The system set forth in claim 8 wherein:

said sleeve member includes orifices spaced apart longitudinally along said sleeve member.

* * * * *